US008989615B2

(12) United States Patent
Matsuno

(10) Patent No.: US 8,989,615 B2
(45) Date of Patent: Mar. 24, 2015

(54) IMAGE FORMING APPARATUS

(71) Applicant: KYOCERA Document Solutions Inc., Osaka-shi, Osaka (JP)

(72) Inventor: Akinori Matsuno, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/079,532

(22) Filed: Nov. 13, 2013

(65) Prior Publication Data

US 2014/0147161 A1 May 29, 2014

(30) Foreign Application Priority Data

Nov. 27, 2012 (JP) ..... 2012-258971

(51) Int. Cl.
*G03G 21/20* (2006.01)

(52) U.S. Cl.
CPC ..... *G03G 21/20* (2013.01); *G03G 21/206* (2013.01)
USPC ..... 399/92

(58) Field of Classification Search
USPC ..... 399/92
See application file for complete search history.

(56) References Cited

U.S. PATENT DOCUMENTS

| | | | | |
|---|---|---|---|---|
| 2007/0059024 | A1* | 3/2007 | Kitayama | 399/92 |
| 2009/0202268 | A1* | 8/2009 | Furukawa | 399/92 |
| 2010/0329726 | A1* | 12/2010 | Kasuga | 399/92 |

FOREIGN PATENT DOCUMENTS

| | | | |
|---|---|---|---|
| JP | 05150677 | A | 6/1993 |
| JP | 2000098860 | A | 4/2000 |
| JP | 2002072729 | A | 3/2002 |
| JP | 2005106965 | A | 4/2005 |
| JP | 2010052840 | A | 3/2010 |
| JP | 2010072399 | A | 4/2010 |
| JP | 2011191706 | A | 9/2011 |

* cited by examiner

*Primary Examiner* — WB Perkey
(74) *Attorney, Agent, or Firm* — Alleman Hall McCoy Russell & Tuttle LLP

(57) ABSTRACT

An image forming apparatus according to one aspect of the present disclosure includes a blowing portion and an air guide portion. The blowing portion blows air to a conveyance path of a sheet from a fixing device to a sheet discharge port. The air guide portion guides air blown from the blowing portion toward the downstream side in a sheet conveyance direction toward the sheet discharge port on the conveyance path.

8 Claims, 10 Drawing Sheets

IMAGE FORMING APPARATUS

INCORPORATION BY REFERENCE

This application is based upon and claims the benefit of priority from the corresponding Japanese Patent Application No. 2012-258971 filed on Nov. 27, 2012, the entire contents of which are incorporated herein by reference.

BACKGROUND

The present disclosure relates to an image forming apparatus including a mechanism of blowing air to a conveyance path on which a sheet passing through a fixing device is conveyed to a sheet discharge port.

An image forming apparatus such as a facsimile apparatus, a copy machine, a printer, or a multifunction peripheral having functions of these apparatuses includes a fixing device. The fixing device includes a heating device, and applies heat to a print sheet when the print sheet passes through the fixing device. Thus, an image is formed on the print sheet passing through the fixing device. The print sheet passing through the fixing device is discharged onto an external tray from a sheet discharge port.

In the image forming apparatus of this type, the sheet heated to a high temperature is conveyed on the conveyance path, while releasing heat, but in some cases, the sheet is discharged without a heat decrease. In this case, melted toner is not completely solidified, so that the toner might be transferred onto another sheet stacked on a tray, or the discharged print sheet might be adhered to another print sheet. On the other hand, a fixing device or an image forming apparatus that cools a sheet heated to a high temperature with a cooling fan or the like is disclosed.

However, in this fixing device, since air is vertically blown to a front surface of a print sheet, air blown to the print sheet flows toward the fixing device, resulting in that the heating device in the fixing device might also be cooled. Moreover, the print sheet is curled up from a guide by the flow of air flown into the fixing device, which hinders the conveyance of the print sheet, and in addition to this, a problem of jam of the print sheet might arise in some cases. In an image forming apparatus having a configuration of blowing air to a print sheet discharged from a sheet discharge port, air is not flown toward the fixing device. However, toner on the print sheet passing through the fixing device might be deposited onto a guide on a conveyance path. The print sheet is made of plant fiber as a main material, so that it has a property of easily retaining water. Therefore, when the print sheet is heated to a high temperature by the fixing device, water in the print sheet evaporates, and stays on the conveyance path in some cases. In this case, in the image forming apparatus having a configuration of not blowing air to the conveyance path, dew condensation occurs on the conveyance path, resulting in that the print sheet might become wet.

SUMMARY

An image forming apparatus according to one aspect of the present disclosure includes a blowing portion and an air guide portion. The blowing portion blows air to a conveyance path of a sheet from a fixing device to a sheet discharge port. The air guide portion guides air blown from the blowing portion toward the downstream side in a sheet conveyance direction toward the sheet discharge port on the conveyance path.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

FIGS. 2A and 2B are sectional views showing the configuration of the image forming apparatus shown in FIG. 1, wherein FIG. 2A is a schematic sectional view, and FIG. 2B is a detailed sectional view.

DETAILED DESCRIPTION

Figure 1:
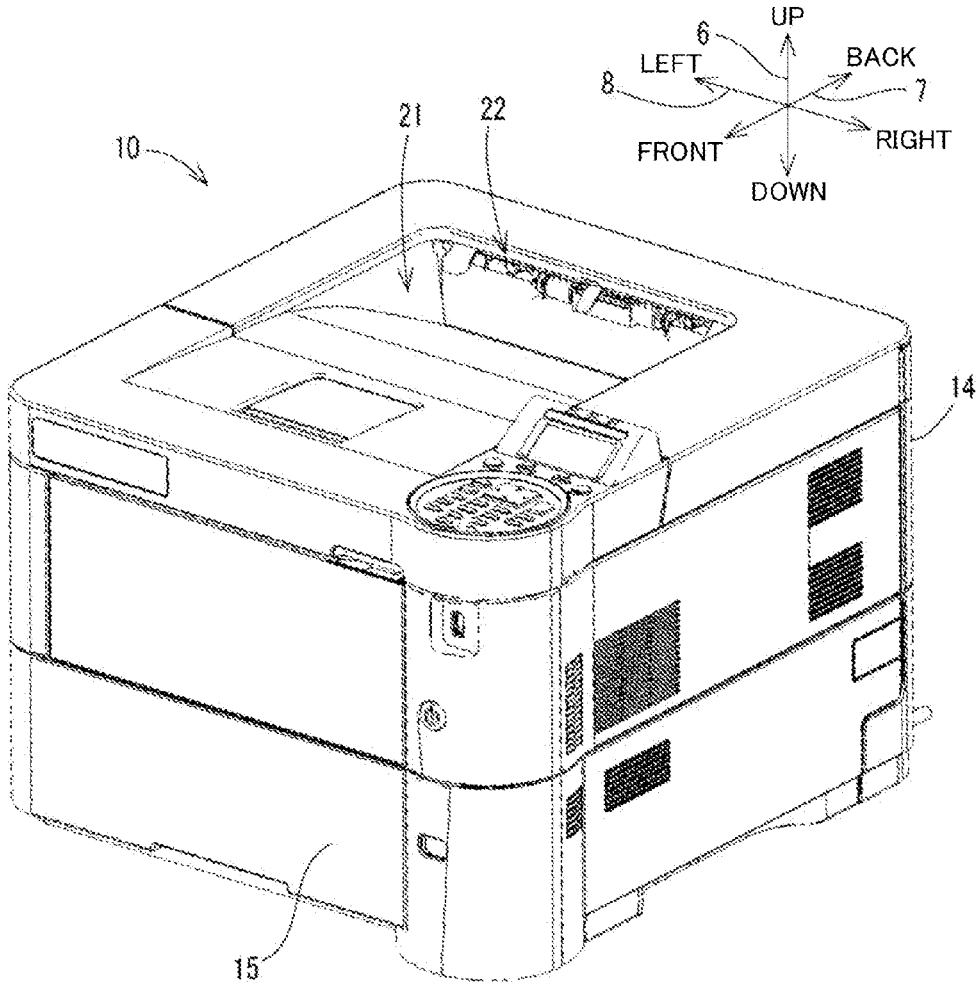
FIG. 1 is a perspective view showing the configuration of the appearance of an image forming apparatus according to an embodiment of the present disclosure.

Hereinafter, embodiments of the present disclosure will be described in detail based on the drawings. It is noted that the embodiments described below are merely embodied examples of the present disclosure, and the embodiments of the present disclosure can be modified as appropriate within a range not changing the gist of the present disclosure.

In the description below, an up-down direction 6 is defined with reference to the state (state in FIG. 1) in which an image forming apparatus 10 is placed so as to be usable, a front-back direction 7 is defined such that the near side (front side) is front, and a right-left direction 8 is defined such that the image forming apparatus 1 is viewed from the near side (front side).

[Configuration of Image Forming Apparatus 10]

As shown in FIG. 1, the image forming apparatus 10 is a multifunction peripheral.

Figure 2A:
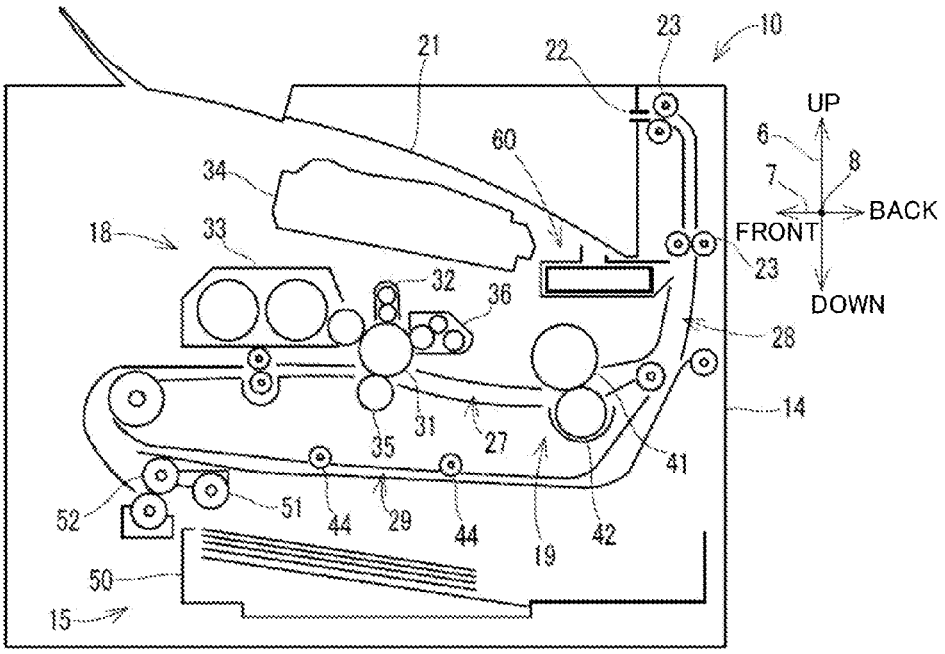
Figure 2B:
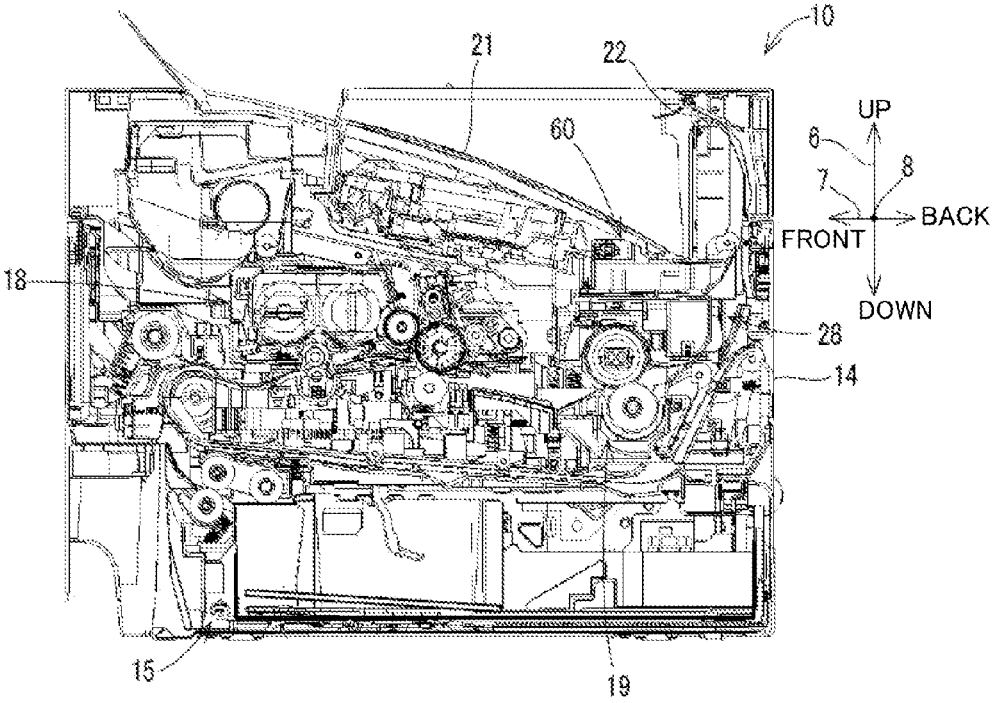

As shown in FIGS. 1 and 2, the image forming apparatus 10 includes an image forming portion 18 of electrophotographic type, a fixing portion 19, a sheet feed device 15, a blowing mechanism 60, a control portion 90 (see FIG. 3) that performs overall control for the image forming apparatus 10, and a sheet discharge portion 21. These components are provided inside a housing 14 forming an outer cover and an inner frame of the image forming apparatus 10.

As shown in FIG. 2, the sheet feed device 15 is provided at the lowermost portion of the image forming apparatus 10. The sheet feed device 15 includes a sheet feed tray 50, a pickup roller 51, and a sheet feed roller 52. In the sheet feed tray 50, print sheets on which an image is to be formed by the image forming portion 18 are stacked. The sheet feed tray 50 is supported by the housing 14. The pickup roller 51 and the sheet feed roller 52 are provided on the front side above the sheet feed tray 50. When an instruction to start a feeding operation of a print sheet is inputted to the image forming apparatus 10, the pickup roller 51 is rotationally driven by a conveyance motor 56 (see FIG. 3), whereby the print sheet is fed from the sheet feed tray 50. The print sheet fed by the pickup roller 51 is conveyed downstream in the feeding direction by the sheet feed roller 52.

The image forming portion 18 transfers a toner image onto a print sheet by using a print material such as a toner. Specifically, as shown in FIG. 2, the image forming portion 18 includes a photosensitive drum 31, a charging portion 32, a developing portion 33, a transfer portion 35, a cleaning portion 36, and an LSU (Laser Scanning Unit) 34. The photosensitive drum 31 is an example of a member to be scanned of the present disclosure. The LSU 34 is an example of a scanning device of the present disclosure. When an image forming operation is started, the surface of the photosensitive drum 31 is charged to have a uniform potential by the charging portion 32. The photosensitive drum 31 from the LSU 34 is scanned with laser beam according to image data. Thus, an electrostatic latent image is formed on the photosensitive drum 31. Thereafter, toners are deposited onto the electrostatic latent image by the developing portion 33, whereby a toner image is developed on the photosensitive drum 31. The toner image is transferred onto a print sheet fed from the sheet feed tray 50, by the transfer portion 35. The print sheet having the toner image transferred thereon is fed onto a conveyance path 27 formed from the image forming portion 18 to the fixing portion 19, and is conveyed to the fixing portion 19 provided on the downstream side (that is, the back side) from the image forming portion 18 in the conveyance direction.

The fixing portion 19 fixes a toner image transferred onto a print sheet onto the print sheet by heat, and includes a heat roller 41 and a pressure roller 42. The heat roller 41 is heated to a high temperature by the heating device such as an IH heater during a fixing operation. When a print sheet passes through the fixing portion 19, toner is heated and melted by the fixing portion 19. Thus, the toner image is fixed onto the print sheet, whereby an image is formed onto the print sheet.

A conveyance path 28 is formed on the downstream side from the fixing portion 19 in the conveyance direction. The conveyance path 28 is an example of a conveyance path of the present disclosure. The sheet discharge port 22 from which a print sheet is discharged is provided on an end of the conveyance path 28. Specifically, the conveyance path 28 is formed from the fixing portion 19 to the sheet discharge port 22. The print sheet having an image fixed thereon by the fixing portion 19 is conveyed to the conveyance path 28. The conveyance path 28 is curved upward from the fixing portion 19, and then, extends in the vertical direction. Plural sheet discharge rollers 23 that are rotated bidirectionally by a sheet discharge motor 57 (see FIG. 3) are provided on the conveyance path 28. The print sheet conveyed onto the conveyance path 28 is conveyed upward through the conveyance path 28 by the sheet discharge rollers 23 that are normally rotated by the sheet discharge motor 57, and discharged onto the sheet discharge portion 21 provided on the top face of the image forming apparatus 10, from the sheet discharge port 22.

In the image forming apparatus 10, when an image is formed on both sides of a print sheet, the print sheet passing through the fixing portion 19 and having formed an image on one side is turned over, and is again conveyed to the fixing portion 19 from the upstream side in the conveyance direction. More specifically, the sheet discharge rollers 23 are stopped with the lead end portion of the print sheet having the image formed on one side being exposed to the outside from the sheet discharge port 22. In this case, the print sheet is held such that the trailing end of the print sheet is nipped by the sheet discharge rollers 23. Then, the sheet discharge rollers 23 are reversely rotated by the sheet discharge motor 57 (see FIG. 3), whereby the print sheet is again conveyed on the conveyance path 28 to the fixing portion 19. In other words, the print sheet is fed backward on the conveyance path 28. As shown in FIG. 2, the image forming apparatus 10 is provided with a reverse conveyance path 29 that is branched from the conveyance path 28 and joins the upstream side of the image forming portion 18. The print sheet fed backward on the conveyance path 28 is guided to the reverse conveyance path 29 by a flap not shown. Plural conveyance rollers 44 are mounted on the reverse conveyance path 29, and the print sheet is again conveyed to the image forming portion 18 from the upstream side in the conveyance direction through the reverse conveyance path 29 by the conveyance rollers 44. The print sheet reaching the image forming portion 18 passes through the image forming portion 18 and the fixing portion 19, whereby an image is formed on the reverse side on which the image is not formed. Thereafter, the print sheet having the image formed on both sides is discharged to the sheet discharge portion 21 from the sheet discharge port 22 through the conveyance path 28 by the sheet discharge rollers 23 that are returned to have normal rotation. It is to be noted that the reverse conveyance path 29 and the conveyance rollers 44 that allow the print sheet to be reversed and conveyed toward the upstream side of the fixing portion 19 are one example of a reverse conveyance portion of the present disclosure.

As described above, the print sheet passing through the fixing portion 19 is heated to a high temperature by the heat roller 41. The print sheet is cooled to some extent during the process of the conveyance through the conveyance path 28, but in some cases, the print sheet is discharged from the sheet discharge port 22 with the melted toner being not completely solidified. In this case, the melted toner might be transferred onto another print sheet, or the discharged print sheet might be adhered to another print sheet. Since the print sheet is heated to a high temperature, moisture contained in the print sheet evaporates, and the resultant evaporation might stay on the conveyance path 28 and generate dew condensation. The evaporation staying on the conveyance path 28 might be exhausted from the sheet discharge port 22 as white steam. In order to reduce such phenomena, as shown in FIG. 2, the blowing mechanism 60 is provided above the fixing portion 19 in the image forming apparatus 10 according to the present embodiment. The blowing mechanism 60 includes a cooling fan 61 that takes in ambient air and blows the air to the conveyance path 28. The cooling fan 61 is an example of a blowing portion of the present disclosure. The detail of the blowing mechanism 60 will be described later.

[Configuration of Control Portion 90]

Figure 3:
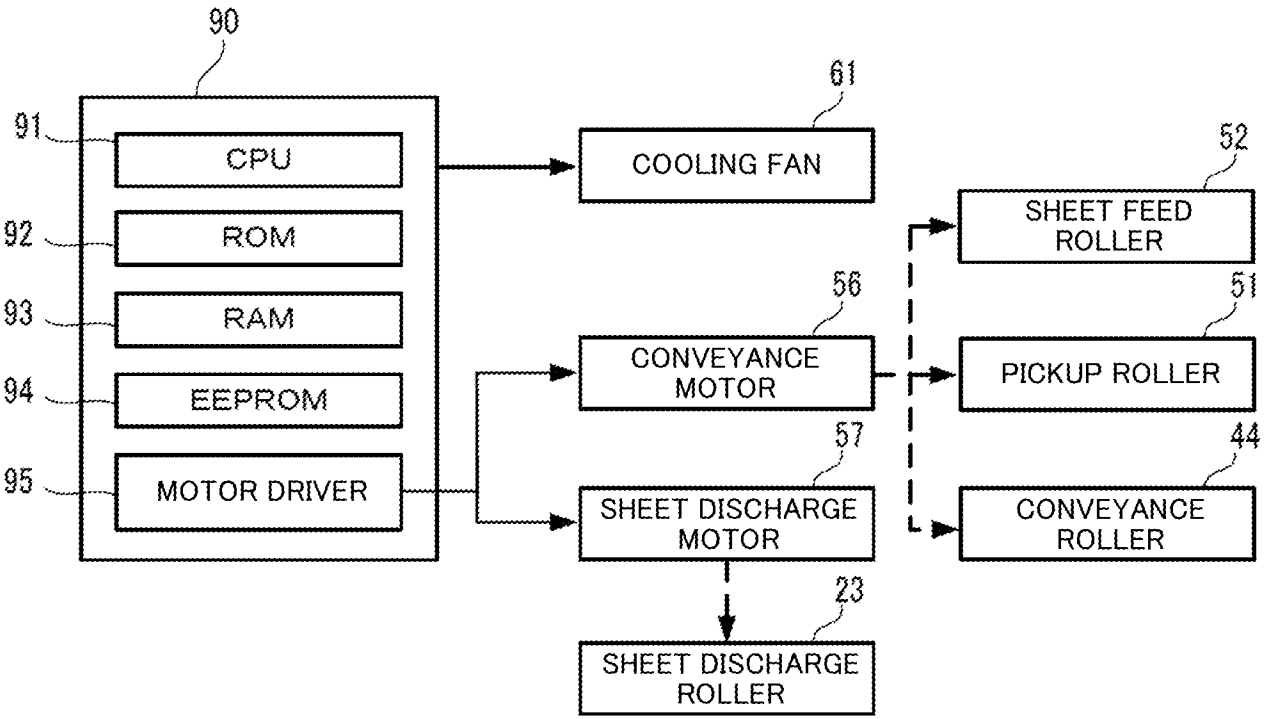
FIG. 3 is a block diagram showing the configuration of a control portion provided to the image forming apparatus shown in FIG. 1.

The control portion 90 performs overall control of the image forming apparatus 10. As shown in FIG. 3, the control portion 90 is composed of a CPU 91, a ROM 92, a RAM 93, an EEPROM 94, a motor driver 95, and the like. The control portion 90 is electrically connected to the conveyance motor 56, the sheet discharge motor 57, and the cooling fan 61 via an internal bus, a signal line, or the like. In addition, the control portion 90 performs a fan drive control in accordance with a flowchart shown in FIG. 8. The fan drive control is a control to drive or stop the cooling fan 61 in the blowing mechanism 60. A control program for performing the fan drive control is stored in the ROM 92. By the control program being executed by the CPU 91, the fan drive control is performed to control the operation of the cooling fan 61. The control portion 90 performing the fan drive control is an example of a control portion of the present disclosure.

The conveyance motor 56 supplies a driving force that rotationally drives the pickup roller 51, the sheet feed roller 52, and the conveyance rollers 44. As shown in FIG. 3, the conveyance motor 56 is connected to the motor driver 95 of the control portion 90, and drive-controlled by the motor driver 95. The sheet discharge motor 57 supplies a driving force that rotationally drives the sheet discharge rollers 23. The sheet discharge motor 57 is connected to the motor driver 95 of the control portion 90.

[Configuration of Blowing Mechanism 60]

Figure 4A:
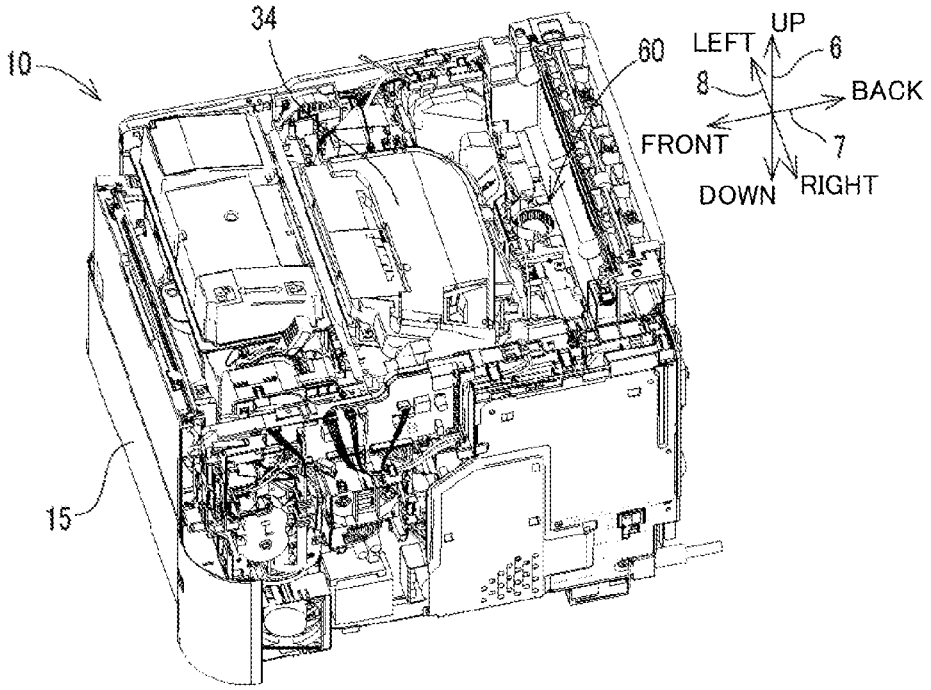
FIG. 4A is a perspective view showing the image forming apparatus from which a top cover is removed.
Figure 4B:
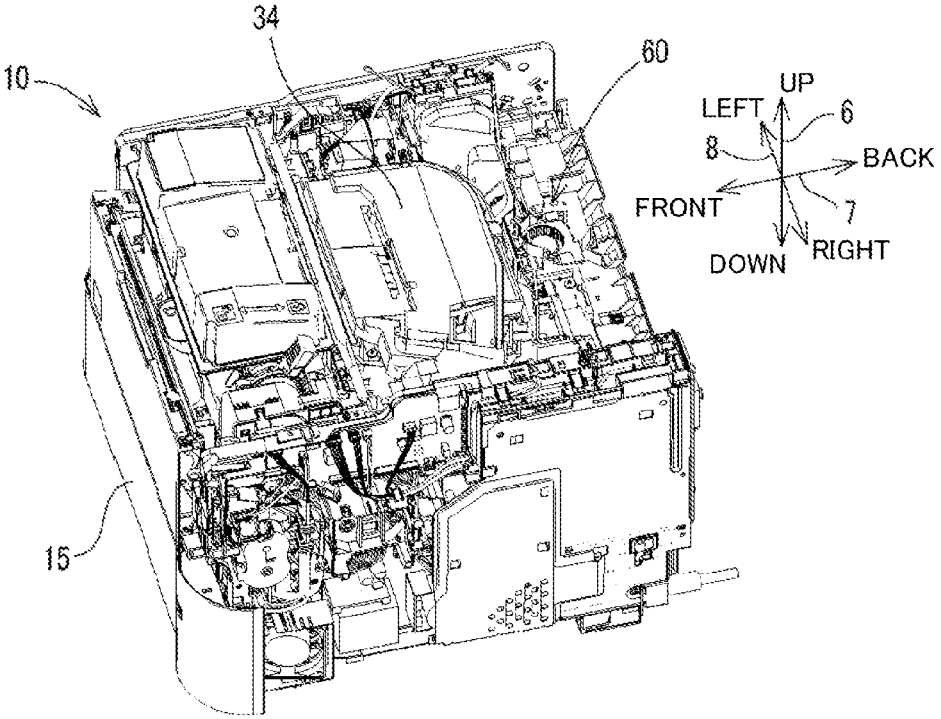
FIG. 4B is a perspective view showing the image forming apparatus from which the top cover and a back cover are removed.

Next, the configuration of the blowing mechanism 60 will be described in detail with reference to FIGS. 4 to 8. As shown in FIG. 4, the blowing mechanism 60 is mounted on the back side of the image forming apparatus 10. The blowing mechanism 60 includes the above-mentioned cooling fan 61 and an air duct 66. The air duct 66 is an example of a branch portion of the present disclosure. In the present embodiment, a sirocco fan (multi-blade fan) is employed as the cooling fan 61.

Figure 5:
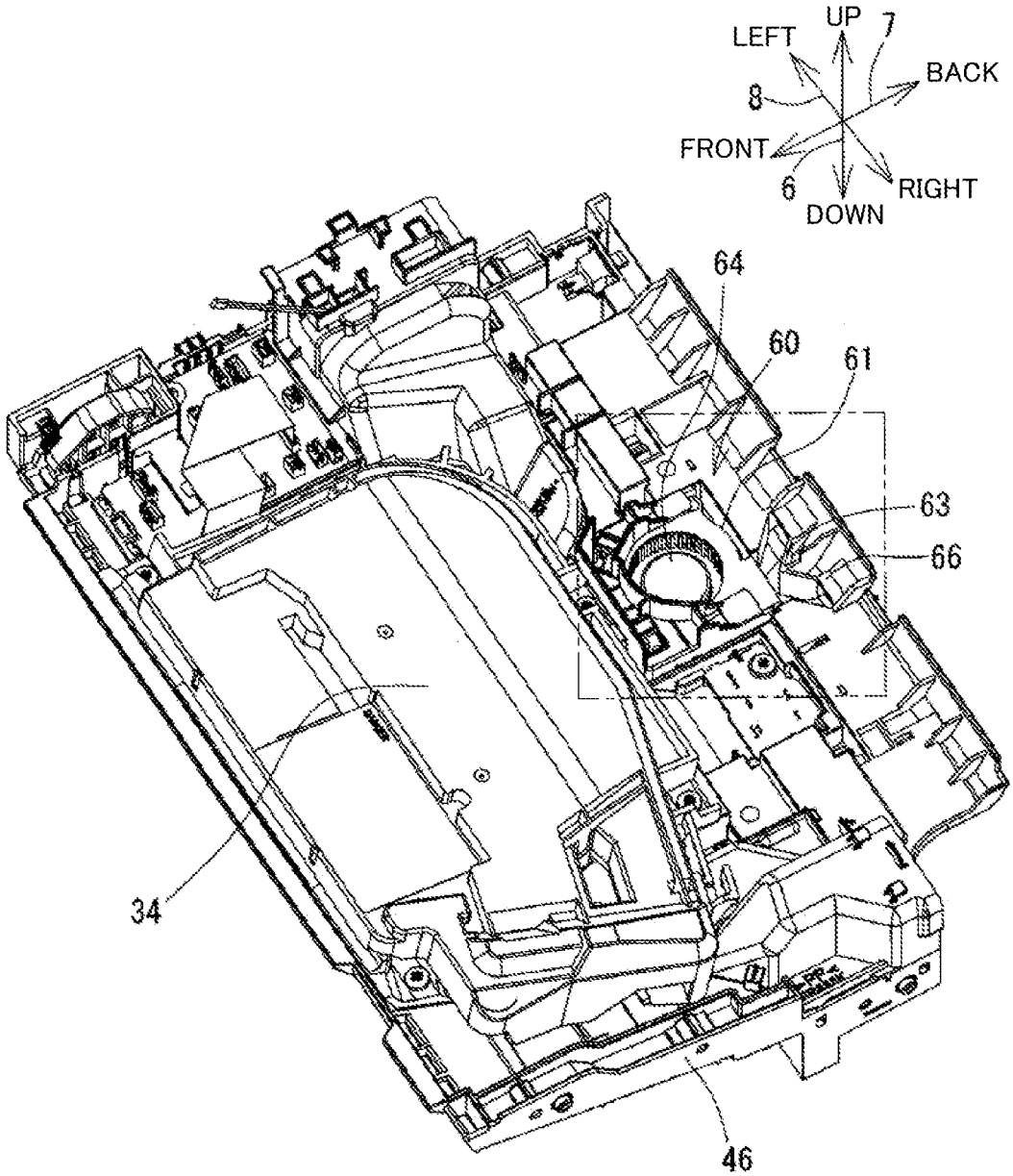
FIG. 5 is a perspective view of the configuration of a periphery of a blowing mechanism provided to the image forming apparatus shown in FIG. 1.
Figure 7:
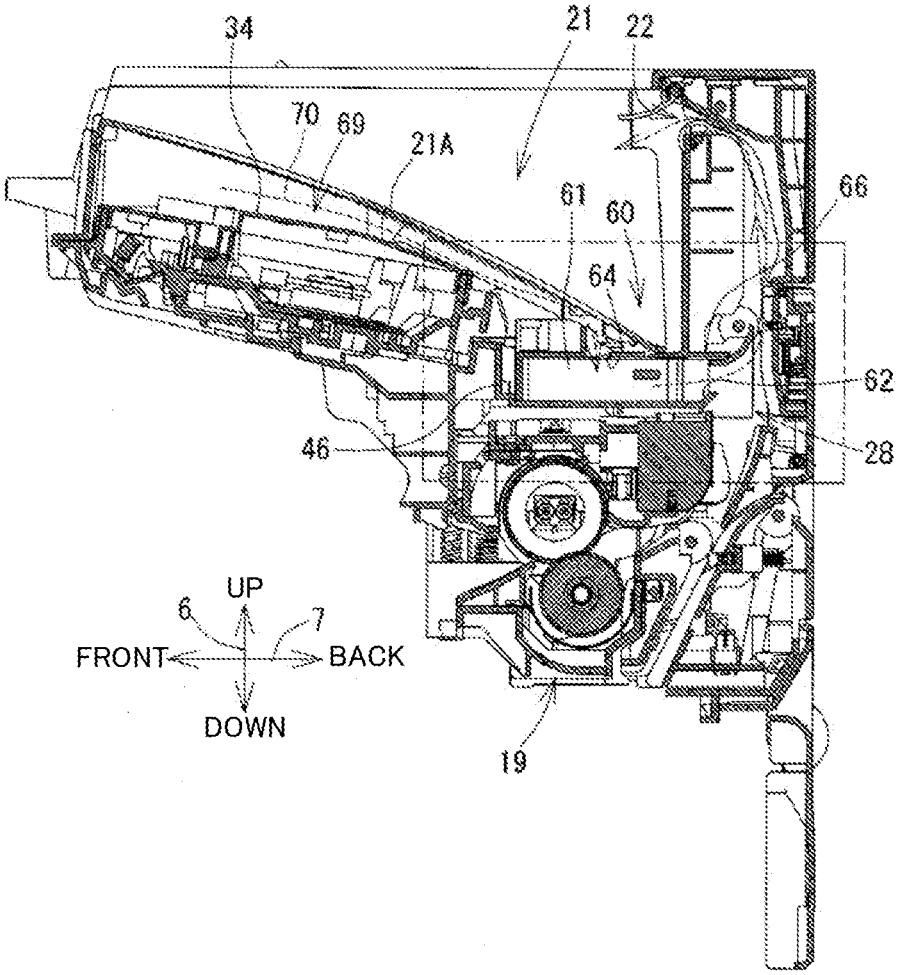
FIG. 7 is a partial sectional view showing the configuration of the periphery of the blowing mechanism provided to the image forming apparatus shown in FIG. 1.

As shown in FIG. 7, the blowing mechanism 60 is arranged above the fixing portion 19 on the back side of the image forming apparatus 10. A frame 46 extending in the lateral direction is provided between the blowing mechanism 60 and the fixing portion 19. The frame 46 has a function as a partition wall that separates the blowing mechanism 60 and the fixing portion 19, and prevents air warmed by the fixing portion 19 from being flown into the blowing mechanism 60. As shown in FIG. 5, the cooling fan 61 of the blowing mechanism 60 is fixed to the frame 46. Specifically, the cooling fan 61 is fixed to the frame 46 such that the rotational shaft of the cooling fan 61 extends in the vertical direction and a blowing outlet 63 of the cooling fan 61 faces the conveyance path 28. An air intake port 64 of the cooling fan 61 is arranged on the top surface.

As shown in FIG. 7, the sheet discharge portion 21 is provided just above the intake port 64 of the cooling fan 61. The sheet discharge portion 21 serves as a part of a cover that covers the top surface of the image forming apparatus 10, and the sheet discharge portion 21 and the cooling fan 61 are separated by a support plate 21A that supports a print sheet at the sheet discharge portion 21. The LSU 34 is arranged on the back surface of the support plate 21A with a slight gap 69. The gap 69 formed between the LSU 34 and the support plate 21A is widened in the widthwise direction (the right-left direction 8) orthogonal to the conveyance direction on the conveyance path 28, and reaches up to both side faces of the image forming apparatus 10 in the right-left direction 8. An intake path 70 (see an arrow of a broken line in FIG. 7) of the cooling fan 61 is formed in the gap 69. In other words, the intake path 70 is formed around the LSU 34. Specifically, both ends or either one of the ends of the gap 69 in the right-left direction 8 communicate with a through-hole, not shown, formed on the side face of the image forming apparatus 10, and outside air can be taken into the gap 69 through the through-hole. The gap 69 is widened to the intake port 64 of the cooling fan 61 along the back surface of the support plate 21A. When the cooling fan 61 is driven, air around the intake port 64 is sucked by the cooling fan 61, so that the periphery of the intake port 64 has a negative pressure state. With this, outside air is flown into the gap 69 through the through-hole. As a result, the intake path 70 from the through-hole through the periphery of the LSU 34 to the intake port 64 of the cooling fan 61 is formed in the gap 69. The intake path 70 formed as described above is an example of an intake path of the present disclosure. Since the intake path 70 is formed around the LSU 34 as described above, the ambient air heated to a high temperature by heat generated from a polygon motor provided in the LSU 34 can be circulated by fresh air. Accordingly, not only a print sheet but also the LSU 34 can be cooled.

Figure 6:
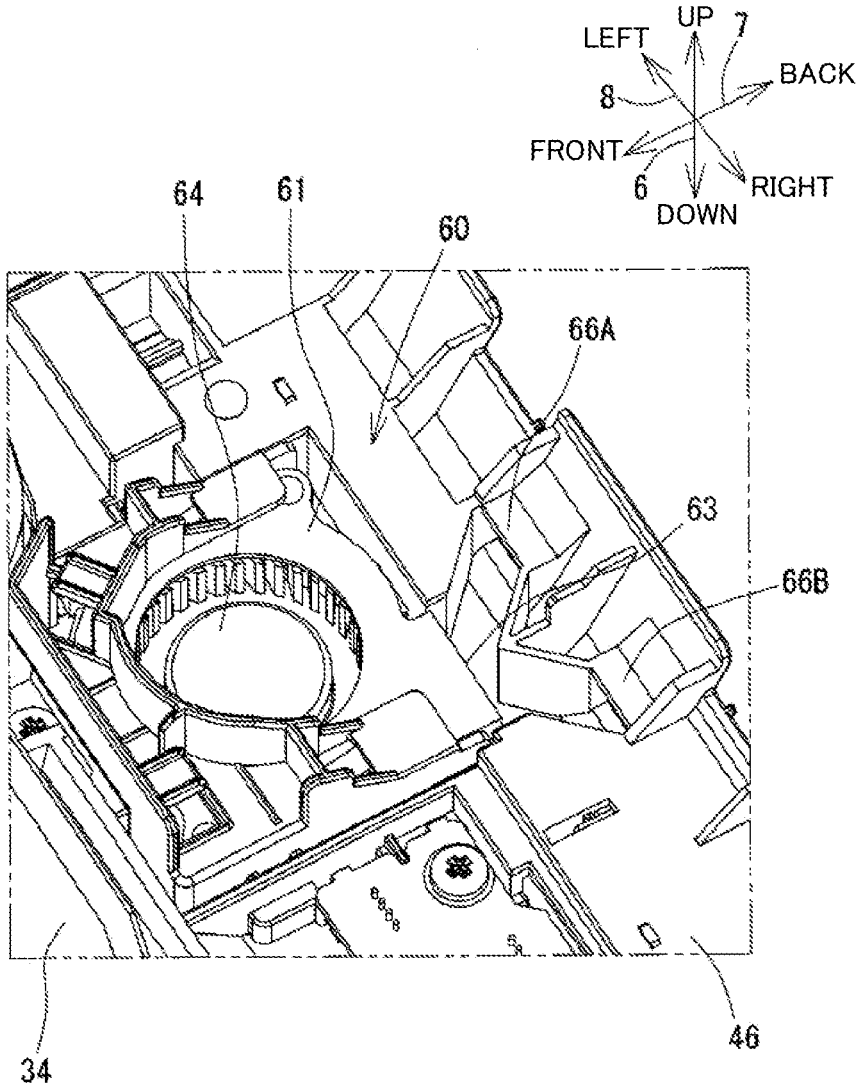
FIG. 6 is an enlarged perspective view showing the configuration of an air duct provided to the blowing mechanism shown in FIG. 5.

The air duct 66 is to send air, which is blown from the blowing outlet 63 of the cooling fan 61, to the conveyance path 28, and is provided between the blowing outlet 63 and the conveyance path 28. In the present embodiment, the air duct 66 is formed integral with the frame 46. The air duct 66 allows the air blown from the blowing outlet 63 of the cooling fan 61 to branch into two in the widthwise direction (i.e., in the right-left direction 8) orthogonal to the conveyance direction. In detail, as shown in FIG. 6, the air duct 66 includes a first duct 66A that sends air blown from the cooling fan 61 toward the conveyance path 28 in the obliquely left direction, and a second duct 66B that sends the air toward the conveyance path 28 in the obliquely right direction. A branch point of the first duct 66A and the second duct 66B is set on the center of the blowing outlet 63. With this structure, the air blown from the blowing outlet 63 is sent as being equally distributed to the first duct 66A and the second duct 66B respectively. Thus, air can be sent to the entire area in the widthwise direction of a print sheet passing through the conveyance path 28. Consequently, the entire area of the print sheet in the widthwise direction can be cooled. In addition, evaporation in the entire area of the conveyance path 28 in the widthwise direction can be exhausted. It is to be noted that the present embodiment discloses the air duct 66 that is branched into two in the right-left direction 8. However, the number of branches is not limited to two, and an air duct 66 that is branched into three or more can also be used.

Figure 8:
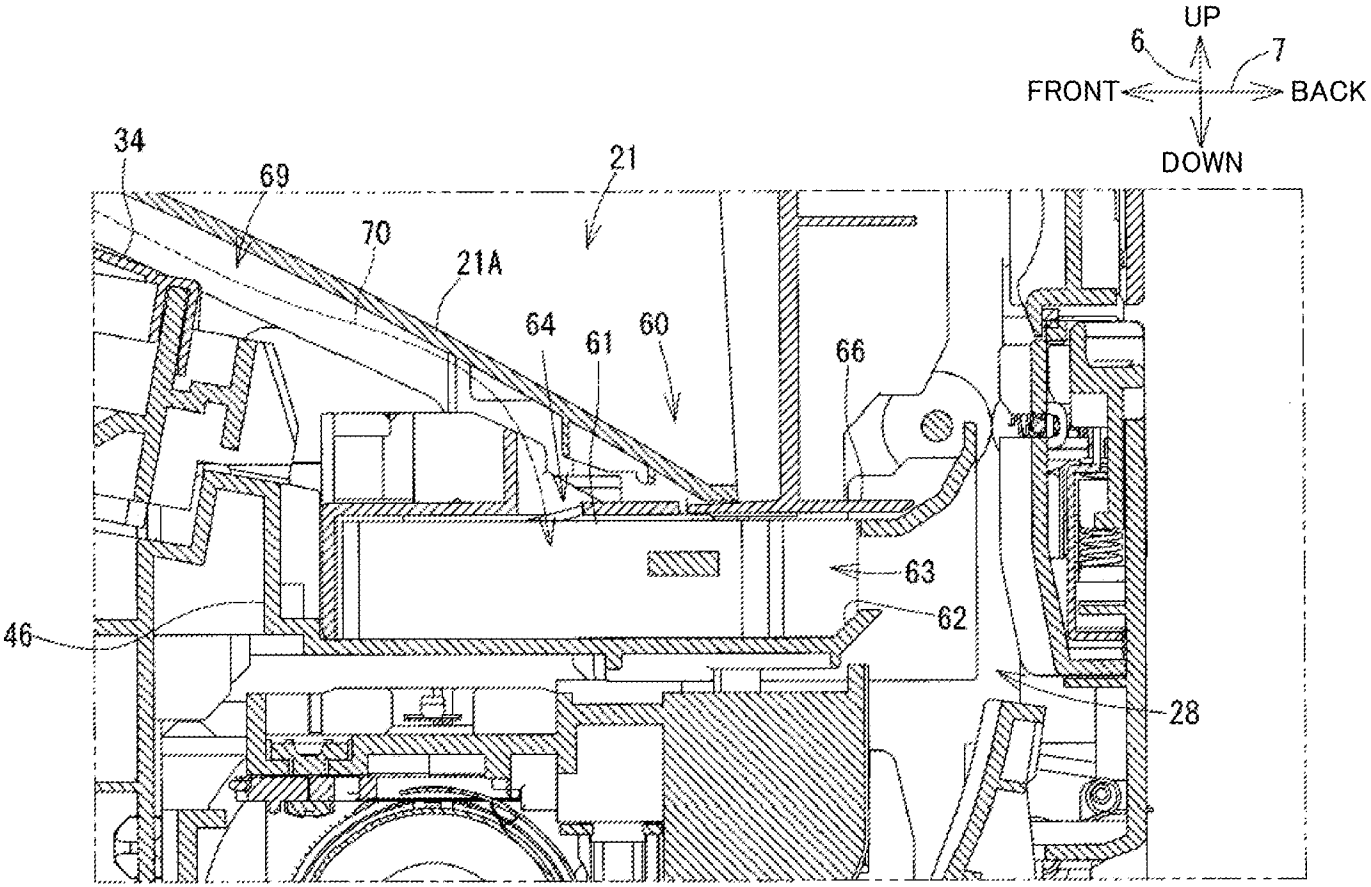
FIG. 8 is a partial enlarged view showing the configuration of the periphery of the blowing mechanism provided to the image forming apparatus shown in FIG. 1.

As shown in FIGS. 7 and 8, an air guide 62 inclined obliquely upward is provided on the air duct 66. Specifically, the air guide 62 is provided to each of the first duct 66A and the second duct 66B. The air guide 62 is an example of an air guide portion of the present disclosure. The air guide 62 guides the air blown from the blowing outlet 63 of the cooling fan 61 toward the downstream side in the conveyance direction of the print sheet on the conveyance path 28. The air guide 66 is provided on a back end portion of the air duct 66 (the first duct 66A and the second duct 66B). The air guide 62 is inclined obliquely upward to the rear from the end portion of a lower surface of the air duct 66. With this structure, the airflow of the air blown from the blowing outlet 63 of the cooling fan 61 is deflected obliquely upward by the air guide 62. Specifically, the air is blown obliquely upward from an outlet of the air duct 66 along an arrow shown in FIG. 8.

[Fan Drive Control]

Figure 9:
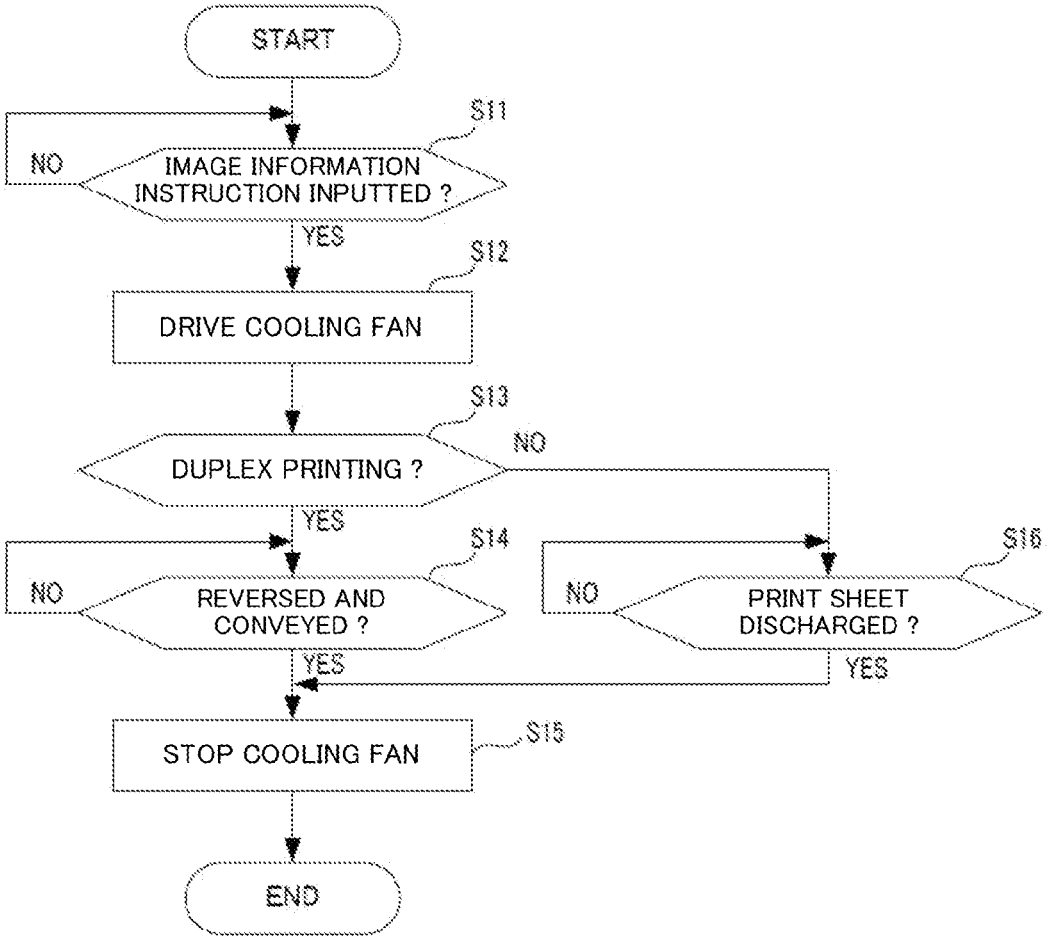
FIG. 9 is a flowchart showing one example of the procedure of a fan drive control executed by the control portion in the image forming apparatus shown in FIG. 1.

A procedure of the fan drive control executed by the control portion 90 during an image formation will be described below with reference to the flowchart in FIG. 9. S11, S12, . . . , in FIG. 9 represent the numbers of steps in the processing procedure. The fan drive control is executed by the control portion 90 in accordance with the procedure, whereby the cooling fan 61 can be driven or stopped.

When the image forming apparatus 10 does not perform the image forming operation, the cooling fan 61 is stopped. When an instruction signal for starting the image forming operation is inputted to the image forming apparatus 10 (S11), the control portion 90 drives the cooling fan 61 (S12). As a result, air is blown from the cooling fan 61 toward the conveyance path 28. The cooling fan 61 may be driven simultaneous with the timing when the instruction of the image formation is inputted. Alternatively, if a sheet sensor for sensing a position of a print sheet is provided on the conveyance path 27, for example, the cooling fan 61 may be driven when the sheet sensor senses an arrival of a print sheet at the fixing portion 19.

The control portion 90 determines whether or not the image forming instruction indicates an instruction of a duplex printing (S13). When determining that the instruction indicates the duplex printing, the control portion 90 determines whether or not the print sheet passing through the fixing portion 19 is reversed and conveyed (S14), and when determining that the print sheet is reversed and conveyed, the control portion 90 stops the cooling fan 61 (S15). It is to be noted that the control portion 90 can determine that the print sheet is reversed and conveyed when, for example, an instruction of an inverse rotation of the sheet discharge motor 57 is inputted. In the case where the sheet sensor is provided on the reverse conveyance path 29, the control portion 90 can determine that a print sheet is reversed and conveyed when the sheet sensor senses the print sheet.

When determining that the image forming instruction indicates simplex printing in step S13, the control portion 90 determines whether or not the print sheet is discharged to the sheet discharge portion 21 (S16). When determining that the print sheet is discharged to the sheet discharge portion 21, the control portion 90 stops the cooling fan 61 (S15). It is to be noted that, when the instruction of driving the sheet discharge motor 57 is lost, the control portion 90 can determine that the image forming operation is ended with the print sheet being discharged onto the sheet discharge portion 21, for example.

[Operation and Effect of Embodiment]

Since the blowing mechanism 60 is provided to the image forming apparatus 10 as described above, air blown from the cooling fan 61 is sent to the conveyance path 28 through the air duct 66. The air guide 62 is provided to the air duct 66, whereby air flown into the conveyance path 28 from the air duct 66 is guided obliquely upward by the air guide 62 as indicated by the arrow in FIG. 8. As a result, a print sheet heated to a high temperature by the fixing portion 19 can efficiently be cooled. Since air is sent toward the sheet discharge port 22, there is no chance that the fixing portion 19 is cooled by blowing air. The evaporation generated from a print sheet due to an application of heat from the fixing portion 19 is forcibly exhausted from the sheet discharge port 22 by the air blown from the cooling fan 61, which prevents not only the stay of the evaporation on the conveyance path 28 but also the occurrence of dew condensation caused by the evaporation. The evaporation is forced to be quickly exhausted, which prevents the evaporation from appearing as white steam from the sheet discharge port 22. Although the embodiment described above discloses the air guide 62 mounted on the air duct 66, the air guide 62 may be mounted on the blowing outlet 63 of the cooling fan 61.

The image forming apparatus 10 has the conveyance path 28 extending in the vertical direction, so that evaporation is easy to stay on the conveyance path 28. However, the image forming apparatus 10 thus configured includes the blowing mechanism 60, whereby cooling of a print sheet and exhaust of steam can smoothly be performed.

When the operation of forming an image on both sides of a print sheet is performed, the cooling fan 61 is driven only when the image is formed on one side, and during the operation of forming the image on the other side, the cooling fan 61 is stopped. This is because moisture is eliminated from the print sheet that has passed through the fixing portion 19 during the simplex printing, and further, because the heating temperature (control temperature) by the heat roller 41 in the fixing portion 19 is set low. Because of these reasons, it is unnecessary to execute the cooling by the cooling fan 61 and to exhaust evaporation. In this case, the cooling fan 61 is stopped during the operation of forming an image on the other side, whereby electric power consumption can be reduced.

[Other Embodiment]

Figure 10:
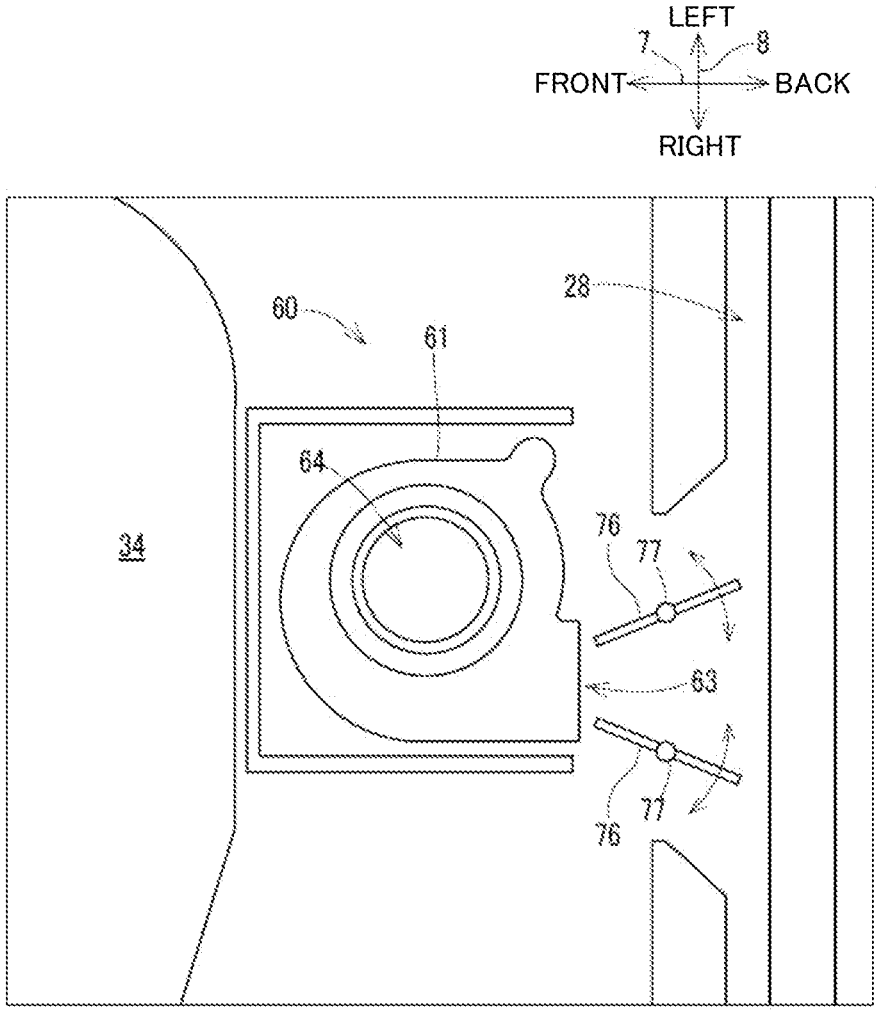
FIG. 10 is a view showing a selection screen for a document size in a reading condition in a display screen scan mode according to the embodiment of the present disclosure.

The embodiment described above discloses the air duct 66 formed integral with the frame 46. However, as shown in FIG. 10, an embodiment in which a deflection plate 76 that is supported to be swingable to the frame 46 (see FIG. 8) is provided instead of the air duct 66 can be employed. The deflection plate 76 changes the direction of the air blown from the cooling fan 61 to the right or left direction, and it can swing in the widthwise direction (right-left direction 8) orthogonal to the conveyance direction of the conveyance path 28 about a swing shaft 77 vertical to the frame 46. The air guide 62 is not mounted to the deflection plate 76. Therefore, in this case, the air guide 62 is provided on the blowing outlet 63 of the cooling fan 61.

In such configuration, when the swing orientation of the deflection plate 76 is deflected to set the deflection plate 76 on any position, the blowing range of the air blown from the cooling fan 61 can optionally be changed. As one example of an orientation changing portion of the present disclosure, an operation lever is provided to the image forming apparatus 10, and a drive transmission mechanism that swings the deflection plate 76 at an angle according to an operation amount of the operation lever is coupled to the swing shaft 77. With this configuration, the orientation of the deflection plate 76 can be changed to change the position of the deflection plate 76 to any position without allowing the inside of the image forming apparatus 10 to be open. Accordingly, when a print sheet is conveyed, air can be sent to a range according to the size of the print sheet in the widthwise direction by swinging the deflection plate 76, for example.

In the case where the image forming apparatus 10 includes a drive source such as a motor coupled to the drive transmission mechanism or a sensing portion for sensing a size of a print sheet on which an image is to be formed, it is conceivable that the control portion 90 drives the motor to change the position of the deflection plate 76 in order to generate the blowing range according to the size of the print sheet. In this case, when a print sheet having a large size in the widthwise direction is conveyed, the blowing range can automatically be increased, and when a print sheet having a small size in the widthwise direction is conveyed, the blowing range can automatically be decreased. It is to be noted that, in this case, the drive source, the sensing portion, and the control portion 90 are an example of the orientation changing portion of the present disclosure.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a blowing portion that blows air to a sheet conveyance path from a fixing device to a sheet discharge port;

an orientation changing portion that changes an orientation of a branch portion to a position according to a size of a sheet conveyed on the conveyance path in the widthwise direction; and an air guide portion that guides air blown from the blowing portion downstream in a sheet conveyance direction toward the sheet discharge port in the conveyance path, wherein the branch portion is supported to be swingable in the widthwise direction.

2. The image forming apparatus according to claim 1, wherein the conveyance path extends in a vertical direction.

3. The image forming apparatus according to claim 1, further comprising a branch portion that allows air blown from the blowing portion to branch in a widthwise direction orthogonal to the sheet conveyance direction.

4. The image forming apparatus according to claim 1, further comprising a scanning device that scans a laser beam to a member to be scanned, wherein an intake path of the blowing portion is formed around a scanning device.

5. The image forming apparatus according to claim 1, further comprising:

a reverse conveyance portion that turns over a sheet passing through the fixing device, and conveys again a resultant sheet to the fixing device from an upstream side in the sheet conveyance direction; and a control portion that controls a drive of the blowing portion, wherein the control portion drives the blowing portion when the sheet passes through the fixing device for the first time, and the control portion stops the blowing portion when the sheet conveyed by the reverse conveyance path passes through the fixing device.

6. The image forming apparatus comprising:

a blowing portion that blows air to a sheet conveyance path from a fixing device to a sheet discharge port;

an air guide portion that guides air blown from the blowing portion downstream in a sheet conveyance direction toward the sheet discharge port in the conveyance path;

a branch portion that allows air blown from the blowing portion to branch in a widthwise direction orthogonal to the conveyance direction;

the conveyance path extending in a vertical direction;

wherein the branch portion is supported to be swingable in the widthwise direction, the image forming apparatus further comprising an orientation changing portion that changes an orientation of the branch portion to a position according to a size of a sheet conveyed on the sheet conveyance path in the widthwise direction.

7. An image forming apparatus comprising:

a scanning device that scans a member to be scanned with a laser beam;

a blowing portion that takes in air from an intake path formed around the scanning device, and blows air toward a sheet conveyance path extending in a vertical direction from a fixing device to a sheet discharge port;

an air guide portion that guides air blown from the blowing portion downstream in the sheet conveyance direction toward the sheet discharge port in the conveyance path;

a branch portion that is supported to be swingable in a widthwise direction orthogonal to the sheet conveyance direction, and allows air blown from the blowing portion to branch in the widthwise direction;

a reverse conveyance portion that turns over a sheet passing through the fixing device, and conveys again a resultant sheet to the fixing device from an upstream side in the sheet conveyance direction;

an orientation changing portion that changes an orientation of the branch portion to a position according to a size of a sheet conveyed on the conveyance path in the widthwise direction; and a control portion that controls a drive of the blowing portion, wherein the control portion drives the blowing portion when the sheet passes through the fixing device for the first time, and the control portion stops the blowing portion when the sheet conveyed by the reverse conveyance path passes through the fixing device.

8. The image forming apparatus according to claim 6, further comprising a scanning device that scans a laser beam to a member to be scanned, wherein an intake path of the blowing portion is formed around the scanning device.

* * * * *